US010714873B2

(12) United States Patent
Beneke et al.

(10) Patent No.: US 10,714,873 B2
(45) Date of Patent: Jul. 14, 2020

(54) PLUG WITH PROTECTIVE CONDUCTOR BRIDGE

(71) Applicant: HARTING Electric GmbH & Co. KG, Espelkamp (DE)

(72) Inventors: Andre Beneke, Vechta (DE); Thomas Beischer, Espelkamp (DE)

(73) Assignee: HARTING Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/479,304

(22) PCT Filed: Jan. 16, 2018

(86) PCT No.: PCT/DE2018/100028
§ 371 (c)(1),
(2) Date: Jul. 19, 2019

(87) PCT Pub. No.: WO2018/141327
PCT Pub. Date: Aug. 9, 2018

(65) Prior Publication Data

US 2019/0386436 A1 Dec. 19, 2019

(30) Foreign Application Priority Data

Feb. 6, 2017 (DE) ..... 10 2017 102 223

(51) Int. Cl.
*H01R 13/648* (2006.01)
*H01R 13/655* (2006.01)
(Continued)

(52) U.S. Cl.
CPC ..... *H01R 13/655* (2013.01); *H01R 13/512* (2013.01); *H01R 13/516* (2013.01); *H01R 13/53* (2013.01)

(58) Field of Classification Search
CPC .... H01R 13/655; H01R 13/53; H01R 13/516; H01R 13/512; H01R 12/724;
(Continued)

(56) References Cited

U.S. PATENT DOCUMENTS 2,935,725 A * 5/1960 Fox ..... H01R 12/721 439/633
5,980,272 A * 11/1999 McHugh ..... H01R 12/7005 439/79
(Continued)

FOREIGN PATENT DOCUMENTS

CN 200972957 11/2007
CN 203351846 U 12/2013
(Continued)

*Primary Examiner* — Jean F Duverne
(74) *Attorney, Agent, or Firm* — Smartpat PLC

(57) ABSTRACT

The disclosure relates to a plug (1) to be mechanically and electrically connected to a corresponding mating plug, comprising a housing (2), a protective conductor bridge (3), and a plug insert. The housing (2) comprises at least one connecting section (9) to be connected to the plug insert, and the plug insert is mounted on the at least one connecting section (9). The protective conductor bridge (3) can be inserted from above into the housing (2) or into retaining frame (4).

13 Claims, 2 Drawing Sheets

(51) Int. Cl.
*H01R 13/512* (2006.01)
*H01R 13/516* (2006.01)
*H01R 13/53* (2006.01)

(58) Field of Classification Search
CPC ..... H01R 13/506; H01R 12/712; H01R 13/2442; H01R 12/721; H01R 12/7005
USPC ..... 439/607.01
See application file for complete search history.

(56) References Cited

U.S. PATENT DOCUMENTS 7,473,133 B1 * 1/2009 Zhang ..... H01R 13/2442 439/607.01
7,618,285 B2 * 11/2009 Xiang ..... H01R 13/512 439/541.5
7,717,721 B2 * 5/2010 Wu ..... H01R 12/712 439/540.1
8,403,683 B2 * 3/2013 Yao ..... H01R 13/506 439/79
2003/0008552 A1 1/2003 Lin
2003/0166348 A1 * 9/2003 Martin ..... H01R 12/724 439/79
2014/0179172 A1 6/2014 Riepe et al.
2015/0024621 A1 1/2015 Diessel et al.
2017/0110824 A1 4/2017 Beischer

FOREIGN PATENT DOCUMENTS

DE 2033011 A1 1/1972
DE 9408909 U1 7/1994
DE 102009055925 6/2011
DE 102012101813 6/2013
DE 102014109351 7/2015
WO 2011069522 A1 6/2011

* cited by examiner

PLUG WITH PROTECTIVE CONDUCTOR BRIDGE

TECHNICAL FIELD

The disclosure relates to a plug for mechanical and electrical connection with a corresponding mating plug.

BACKGROUND

Plugs and mating plugs are used to produce an electric and mechanical connection between two electric lines or an electric line and a device. So-called heavy-duty plugs, which are protected against environmental influences by the housing, are necessary, in particular, for the transmission of large currents.

The principle design of plugs and mating plugs can be substantially identical and only differ in the design of their electric contacts to produce the electrical connection. The realizations for the plugs consequently apply correspondingly to the mating plugs.

Publication WO 2011/069522 A1 discloses a system plug which receives plug-in modules with electric contacts held therein. The plug-in modules are inserted perpendicularly into a region of a holder frame and are then displaced laterally by 90° into the holder frame and secured.

Publication DE 203 30 11 A discloses a safety plug with a plug insert which is arranged in a plug casing where the protective contact is fastened directly to the contact carrier of the plug insert.

Publication DE 10 2014 109 351 B3 provides a plug which enables a secure mechanical and electric connection between plug and mating plug.

DE 10 2012 101 813 B3 discloses a plug with a plug insert and a protective conductor bridge. In this case, the plug insert is held on a connecting region which is realized as a screw connection.

A disadvantage of the previously described plug is that the assembly of the protective conductor bridge and of the plug insert is complex and installation space has to be left free in the housing to install both the plug insert and the protective conductor bridge. As a result, it is necessary to realize the plug in a correspondingly large manner. In addition, such plugs are often very heavy, which makes handling them difficult.

In addition to what has been mentioned above, as part of the priority application to the present application, the German Patent Office and Trademark Office has researched the following prior arts: DE 10 2009 055 925 A1 and DE 94 08 909 U1.

SUMMARY

The object of the invention consists in providing a plug which is simple to handle. The object is achieved by the subject matter as claimed.

The disclosure relates to a plug for mechanical and electrical connection with a corresponding mating plug, comprising a housing and a protective conductor bridge. The housing comprises at least one connecting region for connection with the plug insert, wherein the plug insert is held on the at least one connecting region. The connecting region and the housing are realized in one piece. The protective conductor bridge is insertable from above into the housing. As a result, it is possible to install a plug insert from the plug-in side and from the connection side.

The plug and the mating plug can be realized in an identical manner. The plug can be provided both as a cable plug, for connection with a cable, or as an assembly plug for mounting on a device wall.

The plug consists of a housing which serves for receiving a plug insert. The plug insert is provided for electric contacting with a corresponding plug insert of the mating plug.

In addition, a protective conductor bridge, which serves for the electrical connection of the protective conductor (PE contacts) of the plug insert, is provided in the plug. To this end, the protective conductor bridge is insertable from above into the housing. This provides the advantage of the mechanical stability between housing and protective conductor bridge being measurably greater than when the protective conductor bridge is inserted laterally into the housing.

In one embodiment, the at least one connecting region is realized for producing a screw connection with the plug insert. This means that the connecting region is realized such that it is able to enter into a connection with the plug insert by means of a screw connection. The plug insert is able to be fastened securely to the housing in this way.

In a further embodiment, the at least one connecting region comprises a though-hole. A screw is able to be inserted into said through-hole of the connecting region for fastening purposes.

In a particularly advantageous embodiment, the through-hole of the connecting region comprises an internal thread. Said internal thread is situated on the inside of the through-hole.

In a further alternative embodiment, a screw sleeve is inserted into the housing in the connecting region. Said screw sleeve is introduced in a non-rotatable manner in the connecting region. A screw, with which the plug insert is fastened to the housing, can be screwed into the screw sleeve in the connecting region in this way.

In an advantageous embodiment, the screw sleeve is produced from metal. This ensures secure, stable fastening and screw connection.

In a preferred embodiment, the protective conductor bridge comprises at least one bracket with at least one angulation. In an ideal manner, the bracket comprises two angulations. The angulation is approximately at a right angle with respect to the bracket. In the case of more than one angulation, the angulations always point in the same direction.

In a particularly preferred embodiment, the angulation comprises a through-hole, wherein the through-hole lies with circular symmetry with respect to the through-hole of the connecting region.

In a particularly preferred embodiment, the at least one bracket of the protective conductor bridge is arranged in a slot in the housing. The bracket lies perpendicularly with respect to the through-hole of the connecting region in the slot. The angulation lies parallel to the through-hole of the connecting region. The through-holes are able to be aligned in a flush manner with circular symmetry in this way.

The protective conductor bridge is produced in an expedient manner from an electrically conductive material. In a further, particularly preferred embodiment, the protective conductor bridge is produced in one piece from metal, in a preferred manner from a metal sheet. This is particularly flexible, easy to work and can be produced in a cost-efficient manner. The metal sheet can be processed using punching and bending techniques.

In an advantageous embodiment, the housing comprises at least one latching lug for fixing the protective conductor bridge. The latching lug serves as an additional stabilizing and preliminary fixing option for the protective conductor bridge, in particular for simplifying the assembly.

The advantages of the invention prove particularly effective when the housing is a housing produced from plastics material.

In an alternative embodiment, a holder frame is insertable for receiving a plug insert in the housing. The holder frame is fixed to the housing. The use of a holder frame is advantageous when the housing is a so-called attachment housing.

In a preferred embodiment, the holder frame is suitable for receiving the protective conductor bridge. It comprises at least one one-piece connecting region for this purpose. Said connecting region corresponds in its form and design to the connecting region of the housing. The connecting region of the holder frame is an extension of the connecting region of the housing.

In an embodiment, the holder frame is produced from plastics material. If a holder frame is used with the housing, it also has corresponding through-holes for the connecting regions and corresponding slots. As a result, the protective conductor bridge according to the invention can also be used correspondingly with a holder frame if this is necessary.

The present disclosure achieves the object according to the invention by a protective conductor bridge which can be assembled simply from above into the housing of a plug. As a result, the protective conductor bridge ensures a high level of mechanical stability, particularly with regard to the insertion and removal forces. In addition, it makes simple, rapid and cost-efficient assembly possible.

BRIEF DESCRIPTION OF THE DRAWINGS

An exemplary embodiment of the invention is shown in the drawings and is explained in more detail below.

DETAILED DESCRIPTION

The figures include partially simplified, schematic representations. Identical reference symbols are used in part for same, but where applicable not identical, elements. Various views of the same elements can be scaled in a different manner.

Figure 1:
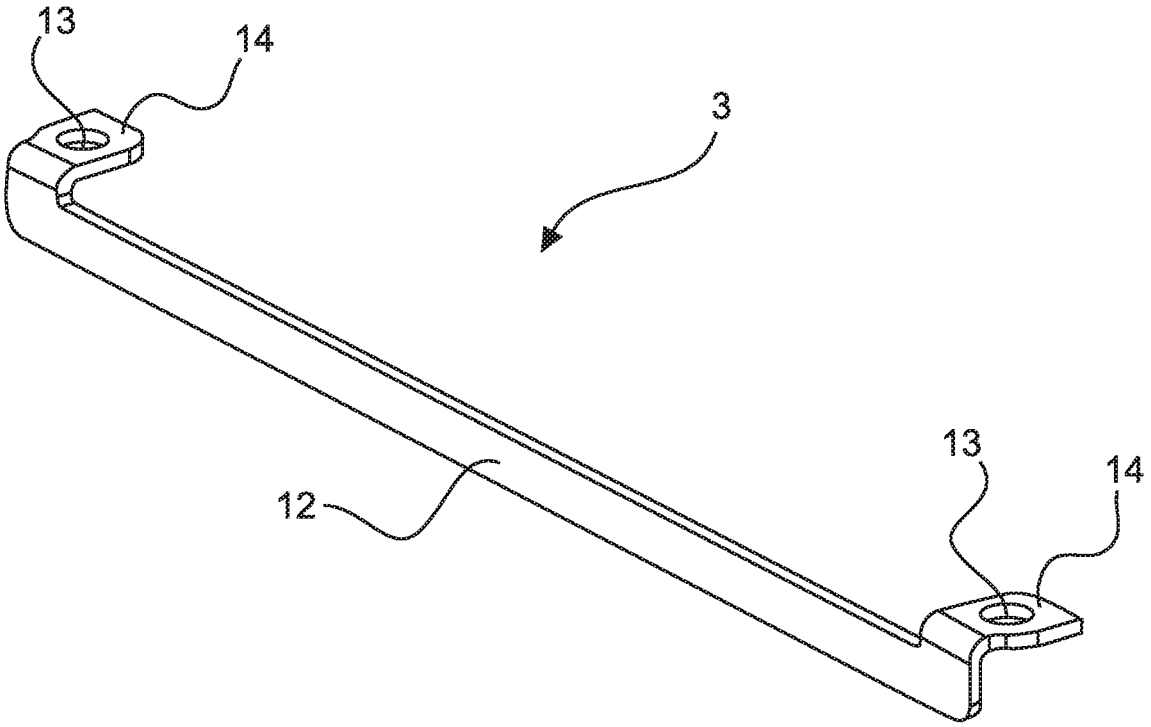
FIG. 1 shows a perspective representation of a protective conductor bridge.

FIG. 1 shows a protective conductor bridge 3. The protective conductor bridge 3 is realized in one piece. It comprises a flat-cuboid bracket 12. The bracket 12 lies in one plane.

Two angulations 14 are integrally formed on the bracket 12. The angulations 14 are formed in an approximately square-shaped manner. They are realized perpendicularly with respect to the flat sides of the bracket 12. In an ideal manner, the angulations 14 are realized in one piece with the bracket 12. In this case, the angulations 14 are bent by approximately 90° degrees. Both angulations 14 are bent in the same direction. The plane of the angulations 14 is arranged perpendicularly with respect to the plane of the bracket 12.

The angulations 14 each comprise a through-hole 13. The center point of the through-hole 13 corresponds to the center point of the angulation 14. The through-hole 13 is arranged centered in the angulation 14.

The punching and bending method serves for producing the protective conductor bridge 3 according to the invention from metal sheet. The protective conductor bridge 3 is insertable into a housing 2. As an alternative to this, the protective conductor bridge 3 is insertable into a holder frame 4.

Figure 2:
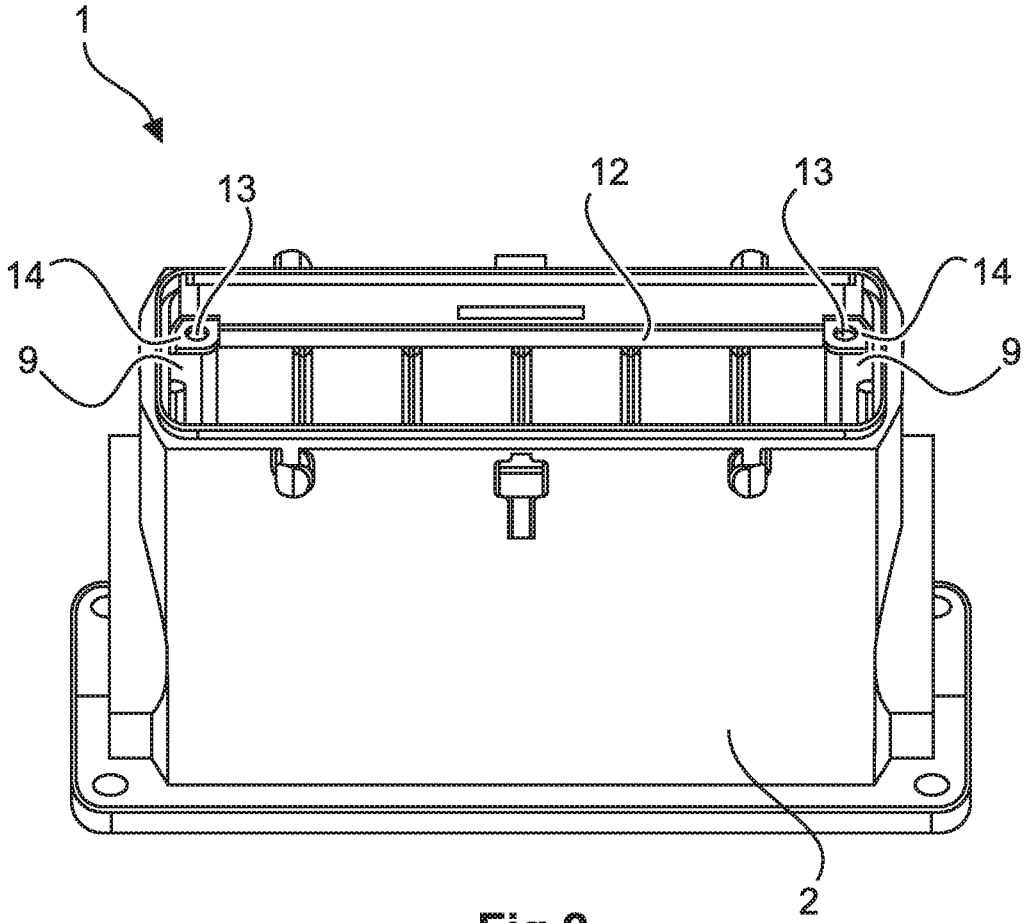
FIG. 2 shows a perspective representation of a housing with the protective conductor bridge inserted.

FIG. 2 shows a perspective representation of a housing 2 of a plug 1. The housing 2 is a plastics material housing. The housing 2 has four connecting regions 9. Only two connecting regions 9 of the four connecting regions can be seen in FIG. 2 due to the perspective representation. The connecting region 9 comprises a through-hole which has an internal thread. The through-hole of the connecting region 9 is hidden in said figure by the angulation 14 and the associated through-hole 13.

The protective conductor bridge 3 from FIG. 1 is inserted in the housing 2. The protective conductor bridge 3, more precisely the bracket 12 of the protective conductor bridge 3, is arranged, in this case, in a slot. The bracket 12 comprises the length of the inside dimension of the housing 2. The through-hole of the connecting region 9 and the through-hole 13 are aligned with circular symmetry and so as to be flush with one another. As a result, the angulation 14 and the connecting region 9 are also aligned in parallel with one another, whilst the bracket 12 is situated perpendicularly thereto.

Figure 3:
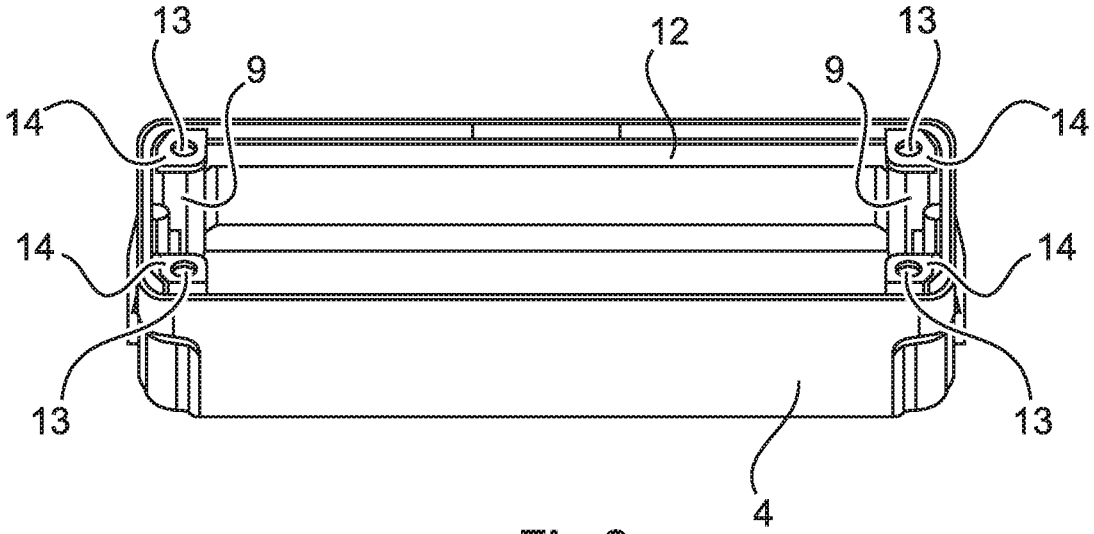
FIG. 3 shows a perspective representation of a holder frame with the protective conductor bridge inserted.

FIG. 3 shows a perspective representation of a holder frame 4. Said holder frame is insertable into a housing of a plug 1. The holder frame 4 is used primarily in combination with an attachment housing. The holder frame 4 consists of plastics material.

The holder frame 4 has four connecting regions 9. Each of said connecting regions 9 comprises a through-hole, each with an internal thread.

The protective conductor bridge 3 from FIG. 1 is inserted in the holder frame 4. The protective conductor bridge 3, more precisely the bracket 12 of the protective conductor bridge 3, is arranged, in this case, in a slot. The bracket 12 comprises the length of the inside dimension of the housing 2. The through-hole of the connecting region 9 and the through-hole 13 are aligned with circular symmetry and so as to be flush with one another. As a result, the angulation 14 and the connecting region 9 are also aligned in parallel with one another, whilst the bracket 12 is situated perpendicularly thereto.

LIST OF REFERENCES

1 Plug
2 Housing
3 Protective conductor bridge
4 Holder frame
9 Connecting region
12 Bracket
13 Through-hole
14 Angulation

The invention claimed is:

1. A plug for mechanical and electrical connection with a corresponding mating plug, comprising:

a housing;

a plug insert; and a protective conductor bridge consisting of an elongated flat cuboid bracket having a first end and a second end, a single first end angulation having a generally square shape extending perpendicular from the first end of the bracket, and a single second end angulation having a generally square shape extending perpendicular from the second end of the bracket, the single first end angulation and the single second end angulation being arranged in a common plane, wherein the housing comprises at least one connecting region for connection with the plug insert, wherein the plug insert is held on the at least one connecting region, wherein the at least one connecting region and the housing are one piece, wherein the protective conductor bridge is insertable into the housing, and wherein the at least one bracket of the protective conductor bridge is arranged in a slot in the housing.

2. The plug as claimed in claim 1, wherein the at least one connecting region is configured for producing a screw connection with the plug insert.

3. The plug as claimed in claim 1, wherein the at least one connecting region comprises a through-hole.

4. The plug as claimed in claim 3, wherein the through-hole of the at least one connecting region has an internal thread.

5. The plug as claimed in claim 3, wherein a screw sleeve is inserted into the housing in the at least one connecting region.

6. The plug as claimed in claim 5, wherein the screw sleeve is produced from metal.

7. The plug as claimed in claim 1, wherein the single first end angulation comprises a through-hole, and wherein the through-hole lies with circular symmetry with respect to the through-hole of the at least one connecting region.

8. The plug as claimed in claim 1, wherein the protective conductor bridge is produced in one piece from a metal sheet.

9. The plug as claimed in claim 1, wherein the housing comprises at least one latching lug for fixing the protective conductor bridge.

10. The plug as claimed in claim 1, wherein the housing consists of plastics material.

11. A plug for mechanical and electrical connection with a corresponding mating plug, comprising:

a housing;

a plug insert; and a protective conductor bridge consisting of an elongated flat cuboid bracket having a first end and a second end, a single first end angulation having a generally square shape extending perpendicular from the first end of the bracket, and a single second end angulation having a generally square shape extending perpendicular from the second end of the bracket, the single first end angulation and the single second end angulation being arranged in a common plane, wherein a holder frame is inserted in the housing, wherein the housing comprises at least one connecting region for connection with the plug insert, wherein the plug insert is held on the at least one connecting region, wherein the at least one connecting region and the housing are one piece, wherein the protective conductor bridge is insertable into the holder frame by moving the protective conductor bridge in a single linear motion parallel to a longitudinal axis of the holder frame, wherein the protective conductor bridge comprises at least one bracket with at least one angulation, and wherein the at least one bracket of the protective conductor bridge is arranged in a slot in the housing.

12. The plug as claimed in claim 11, wherein the holder frame is fixed on the housing.

13. The plug as claimed in claim 11, wherein the holding frame is produced from plastics material.

* * * * *